United States Patent [19]

Le Blanc et al.

[11] 4,073,617

[45] Feb. 14, 1978

[54] WATER-DILUTABLE SOLUTIONS OF DICYANDIAMIDE-FORMALDEHYDE-PHOSPHORIC ACID CONDENSATES

[76] Inventors: Robert Bruce Le Blanc, 99 Main St.; Destin Allen Le Blanc, 115 Main St., both of Wickford, R.I. 02852

[21] Appl. No.: 680,407

[22] Filed: Apr. 26, 1976

[51] Int. Cl.[2] ..... D06M 13/26; D06M 13/44; D06M 1/00

[52] U.S. Cl. ..... 8/116 P; 8/182; 8/184; 252/8.8; 260/29.4 R; 260/69 N; 427/390 C; 427/390 D; 428/276

[58] Field of Search ..... 427/390 D, 390 C; 8/184, 116 P, 182; 260/69 N, 29.4 R; 252/8.8 R, 8.8 AP, 8.8 AG, 8.8 AA; 428/276

[56] References Cited

U.S. PATENT DOCUMENTS

| | | | |
|---|---|---|---|
| 2,482,756 | 9/1949 | Ford et al. | 260/69 N |
| 3,479,211 | 11/1969 | Goldstein | 260/69 N |
| 3,625,753 | 12/1971 | O'Brien et al. | 427/390 D |
| 3,887,511 | 6/1975 | Juneja | 260/69 N |

*Primary Examiner*—Joseph L. Schofer

*Assistant Examiner*—Maria S. Tungol

*Attorney, Agent, or Firm*—Burgess, Dinklage & Sprung

[57] ABSTRACT

In the process for rendering textile materials, especially cellulose-containing tent fabrics, fire-resistant by condensing dicyandiamide with formaldehyde and phosphoric acid, followed by dilution with water and application to the fabric, it has been found that the need to dilute the condensate and apply it promptly after formation can be avoided provided additional phosphoric acid is added from about 0 to 8 hours prior to the dilution. Without such additional phosphoric acid, if the dilution is later effected an insoluble precipitate will form. Thus, the invention permits production and shipping of a clear solution which, to be used, need only be diluted first with additional phosphoric acid and then with water. The initial condensation is preferably effected with about 0.9–3 moles of formaldehyde per mole of dicyandiamide in aqueous solution at a pH of about 8 to 13 and thereafter about 0.06–0.6 mole of phosphoric acid per mole of dicyandiamide and at least about 0.1 mole of the additional phosphoric acid is added per mole of dicyandiamide prior to or at the time of dilution.

11 Claims, No Drawings

WATER-DILUTABLE SOLUTIONS OF DICYANDIAMIDE-FORMALDEHYDE-PHOSPHORIC ACID CONDENSATES

This application relates to storage stable solutions suited for rendering textile materials fire-resistant by simple processing.

It is known to apply fire-resistant finishes to a variety of textile materials. In some instances the material enters the channels of commerce as a powder which must be dissolved by extended mixing prior to application to the textile. Not only is this time consuming but, if dissolution is incomplete, fabric treatment will be non-uniform.

Thus, it is generally recognized that normal mill processing requires liquid treating compositions which can be applied as such or, preferably, which are concentrates that can merely be diluted with water and directly applied. For example, U.S. Pat. No. 2,582,961 discloses the treatment of textiles with a pad bath of a heat curable aminoplast such as trimethylol melamine, a methyl dicyandiamide and an oxygen containing phosphorus acid such as phosphoric acid. The pad bath is prepared by adding all the ingredients and then heating the mixture at about 120° F to cause the ingredients to dissolve. However, bath stability is given as 8 hours, i.e. if the concentrated solution is diluted with water more than 8 hours after preparation instead of a clear dilute solution there will be formed an insoluble material or gummy mass. This phenomenon is known as hydrophobing.

Accordingly, it is necessary to prepare such solutions fresh at a plurality of fabric treating plants rather than centrally at a single manufacturing station with shipping of a storable, dilutable solution.

A product described as Pyroset DO in American Cyanamid Textile Finishing Bulletin No. 130 is believed to be of generally similar chemical composition except that it is a powder with the disadvantages noted above. After about 30 minutes of mixing, the resulting solution can be diluted and applied to textile fabrics but this must be done within 8 hours or the solute will form a gummy precipitate.

U.S. Pat. No. 3,887,511 discloses a fire retardant formulation of a condensate of formaldehyde with urea and discyandiamide with a phosphorus acid. This mixture is claimed to have increased stability, but no criteria are given for measuring stability. While the products in several examples were diluted with water prior to application, apparently such diluton and application take place shortly after the initial condensation before the problem of hydrophobing manifests itself.

It is an object of the present invention, however, to provide a solution of fire-retardant character which can be stored for long periods of time and still be readily diluted with water without manifesting hydrophobing.

This and other objects and advantages are realized in accordance with the present invention pursuant to which there is produced an aqueous solution comprising a condensation product of dicyandiamide with formaldehyde and phosphoric acid. This solution can be diluted with water readily shortly after formaton but, after about 8 hours, it also exhibits hydrophobing upon dilution with water. Pursuant to the present invention, however, this problem of hydrophobing will not be manifested provided to the solution there is added additional phosphoric acid before or simultaneously with the water of dilution.

This is quite surprising since the solution already contains phosphoric acid. Moreover, if the initial solution contained 0.4 or 0.5 mole of phosphoric acid per mole of dicyandiamide hydrophobing will be manifested whereas if it initially contained 0.4 mole of phosphoric acid but 0.1 additional mole is later added, for a total of 0.5 mole, hydrophobing will not be manifested.

Thus, there is provided a liquid product which an unskilled finishing plant laborer can merely drop into a vessel, add liquid phosphoric acid and water of dilution to produce a treating bath whuch can directly be employed. There is no need for extensive mixing, as with powders, and uniformity is nonetheless ensured.

The initial condensate solution, which is the most likely form in which the product would be sold, is prepared by reacting dicyandiamide with about 0.9–3, preferably about 1–1.3, times its molar amount of formaldehyde and about 0.06–0.6, preferably about 0.1–0.5, times its molar amount of phosphoric acid. The condensation reaction is desirably effected between dicyandiamide and formaldehyde in aqueous solution at a pH of about 8–13, employing any suitable base such as sodium hydroxide or carbonate. Commercial 37% formaldehyde may be used most conveniently. The dicyandiamide is methylolated at temperatures from about 120° to 180° F for from about 1 minute to about 1 hour. It has been found preferable to raise the temperature of the reaction slowly to about 135°–150° F, preferably about 140°–145° F, and maintain it at this temperature until the reaction mixture turns clear. This generally takes about 2 to 10 minutes at 140° F. Once the reaction mixture turns clear, it is cooled down to a temperature of about 70°–110° F and at this point a phosphoric acid is added. Suitable acids include orthophosphoric acid and polyphosphoric acids. Since it causes an exotherm, the rate of addition of the phosphoric acid is adjusted such that the maximum temperature reached is about 115° F, preferably about 110° F. The phosphoric acid is generally added at a level of about 0.06–0.6, preferably about 0.1–0.5 mole, per mole of dicyandiamide.

The product obtained at this point is similar to those obtained in U.S. Pat. No. 2,582,961 except that it contains no methylol melamine. It is dilutable with water in all proportions down to 1% product (99 parts water + 1 part product) without formation of either an insoluble material or a cloudy emulsion. However, after standing for more than approximately 8 hours, this property of the product is lost, that is, dilution with water down to 1% produces an insoluble material. Once the product exhibits this property, it is no longer useful since it cannot be diluted to the proper solids level for proper application to textiles, and it is also difficult to clean up after padding since on contact with water, the product forms a gummy residue. Furthermore, on standing the viscosity of the product increases such that it is no longer convenient to pad the material onto textiles.

As noted, however, such hydrophobing will not take place provided additional phosphoric acid is added simultaneously with, or preferably shortly before, the water of dilution, even if the water of dilution is added in 100 times the amount of the concentrate. The amount of phosphoric acid added is at least about 0.1 mole per mole of dicyandiamide, and the total amount added will depend on the level of flame-retardance desired, since the phosphoric acid per se is a flame-retardant. Generally about 0.1–0.5 mole of additional phosphoric acid is adequate.

Products prepared in this way have stabilities on the same order as freshly prepared products, without the necessity of heating the ingredients in the textile finishing mill to enable them to go into solution. The use of the process of this invention also requires less energy in the preparation since only one heating step is required in contrast with the prior art which requires a heating step fo methylolation of the dicyandiamide, a drying step to dry the methylol dicyandiamide and a heating step to solubilize the methylol dicyandiamide in the pad bath.

The stabilized pad baths of this invention after dilution may be used to impart during flame-resistance to cellulosic textile materials comprising cotton, rayon, polyester/cotton blend, and the like. The products may be applied "as is" to provide flame-retardance, or in conjunction with a water-repellent to provide flame-resistant water-resistant textiles particularly suitable for use as tent fabrics. The treating bath may also contain an aminoplast resin or formaldehyde to increase durability. Textiles are treated in conventional pad-dry-cure processes.

The following examples serve to illustrate the invention; all parts are by weight unless otherwise expressed:

EXAMPLE 1

Products were made from dicyandiamide, formaldehyde supplied as a 37% solution in water and phosphoric acid supplied as a 75% solution in water in the quantities recited in Table I. The dicyandiamide was slurried with the formaldehyde, and the pH was adjusted to 10 with soda ash. The slurry was heated to 140° F and then kept there for 10 minutes, producing a clear solution which was cooled to 85° F. At that point the phosphoric acid was added gradually so that the solution did not exotherm above 155° F. All products were tested initially and after 24 hours by adding 99 ml of water to 1 ml of solution. All of the solutions upon dilution shortly after preparation stayed clear but, upon dilution 24 hours after preparaton, an insoluble material forms, this formation being identified as hydrophobing.

TABLE I

| | A | B | C | D | E | F |
|---|---|---|---|---|---|---|
| Parts Dicyandiamide | 20 | 20 | 20 | 20 | 20 | 20 |
| Parts 37% $CH_2O$ | 23 | 23 | 30 | 20 | 24 | 20 |
| Parts 75% $H_3PO_4$ | 10 | 5 | 7.5 | 3.5 | 15 | 7 |
| Initial hydrophobing | no | no | no | no | no | no |
| 24-hour hydrophobing | yes | yes | yes | yes | yes | yes |

EXAMPLE 2

To the undiluted solutions prepared in Example 1, both 24 hours and three months after preparation there were added various amounts of $H_3PO_4$ as a 75% solution in water. The amounts of phosphoric acid listed in Table II were added to 50 parts of the methylol dicyandiamide/phosphoric acid condensates of Example 1. After addition of the phosphoric acid, the samples were tested for hydrophobing. It can be seen that by this phosphoric acid treatment all the solutions of Example 1 were rendered dilutable even though they had previously been aged three months.

TABLE II

| Product | G | H | I | J | K | L | M | N | O | P | Q | R |
|---|---|---|---|---|---|---|---|---|---|---|---|---|
| Solution of Table I | A | A | B | B | C | C | D | D | E | E | F | F |
| Parts $H_3PO_4$ | 3 | 5 | 7 | 15 | 3 | 7 | 12 | 16 | 3 | 5 | 3 | 12 |
| Hydrophobing of 24-hour product | no | no | no | no | no | no | no | no | no | no | no | no |
| Hydrophobing of 3-mo. product | no | no | no | no | no | no | no | no | no | no | no | no |

EXAMPLE 3

Pad baths for treating textiles were prepared according to Table III. The phosphoric acid was added to the methylol dicyandiamide/phosphoric acid condensates as a 75% solution. Then the water was added along with the water repellent and/or formaldehyde (as a 37% solution) if used.

TABLE III

| | Pad Baths | | |
|---|---|---|---|
| | 1 | 2 | 3 |
| Parts of solution A from Table I | 60 | — | — |
| Parts of solution D from Table I | — | 40 | 50 |
| Parts of 75% $H_3PO_4$ | 8 | 8.8 | 11 |
| Parts Water | 32 | 36 | 23 |
| Parts Aerotex 96* | — | 12 | 12 |
| Parts 37% $CH_2O$ | — | 3.2 | 4 |

*A Water repellent from American Cyanamid Co. containing a stearamide melamine condensate.

Fabrics listed in Table IV were padded with the pad bath formulations indicated. The fabrics were dried at 250° F for five minutes and then cured for 1½ minutes at 350° F. One sample, as indicated, was washed for five minutes in a Kenmore home washer in 140° F water. All fabrics were tested for flame-resistance by CPAI-84 specifications. All passed these specifications.

In addition, those fabrics treated with pad baths 2 and 3 containing a water repellent passed a bag test showing no water leakage after 24 hours, thus showing good water resistance. The bag test consisted of forming a bag from a 12 × 12 in. square of material, suspending the bag from a support structure, and adding 250 ml of water to the bag. Failure in this test is evidenced by leakage of water through the fabric. Passage of the test indicates the fabric is especially suited for fabrication of tents.

TABLE IV

| | Fabrics Treated | | |
|---|---|---|---|
| Fabric | 9.9 oz./sq.yd. cotton duck | 5.5 oz./sq.yd. cotton drill | 7.8 oz./sq.yd. 50/50 polyester /cotton duck |
| Pad bath from Table III | 1 | 2 | 3 |
| % Wet Pick-up | 55 | 87 | 76 |
| Process wash | yes | no | no |
| CPAI-84 char lengths (inches) initial | 2.9 | 3.9 | 5.2 |

TABLE IV-continued

| | Fabrics Treated | | |
|---|---|---|---|
| After leach | 3.3 | 4.1 | 5.3 |

It will be appreciated that the instant specification and examples are set forth by way of illustration and not limitation, and that various modifications and changes may be made without departing from the spirit and scope of the present invention.

What is claimed is:

1. In the process for rendering textile materials fire-resistant wherein dicyandiamide is condensed with formaldehyde and sufficient phosphoric acid ultimately to impart fire-resitance, diluted with water and applied to a textile material, the improvement which comprises effecting the condensation of dicyandiamide, with formaldehyde adding phosphoric acid to produce a solution, and adding additional phosphoric acid more than a day after the reaction and less than about 8 hours prior to the dilution with water, whereby such dilution with water is effected without formation of an insoluble material.

2. The process of claim 1, wherein at least about 0.1 mole of the additional phosphoric acid is added per mole of dicyandiamide.

3. The process of claim 2, wherein about 0.1 – 0.5 mole of the additional phosphoric acid is added per mole of dicyandiamide.

4. The process of claim 1, wherein the condensation is effected with about 0.9 – 3 moles of formaldehyde per mole of dicyandiamide in aqueous solution at a pH of about 8 to 13 and thereafter adding about 0.06–0.6 mole of phosphoric acid per mole of dicyandiamide.

5. The process of claim 1, wherein the textile material comprises cellulose.

6. The process of claim 5, wherein the textile material is a cellulose-based tent fabric.

7. The process of claim 3, wherein the condensation is effected with about 1 – 1.3 moles of formaldehyde per mole of dicyandiamide in aqueous solution at a pH of about 8 to 13 and thereafter to the condensation product is added initially about 0.1 – 0.5 mole of phosphoric acid per mole of dicyandiamide, and the textile material is cellulose.

8. A composition capable of being diluted with water to a textle fire-resisting finish, comprising a condensation product of dicyandiamide with about 0.9 – 3 moles of formaldehyde per mole of dicyandiamide in aqueous solution at a pH of about 8 to 13 and an initial addition of about 0.06–0.6 mole of phosphoric acid per mole of dicyandiamide and containing additional phosphoric acid added more than a day after the initial addition of phosphoric acid but less than 8 hours prior to the dilution of said composition with water whereby such dilution with water is effected without formation of an insoluble material.

9. The composition of claim 8, further containing a water-repellent.

10. The composition of claim 8, wherein the additional phosphoric acid added is at least about 0.1 mole per mole of dicyandiamide, whereby said solution can be diluted with water without formation of an insoluble material.

11. The composition of claim 10, wherein the initial condensation product comprises about 1 – 1.3 moles of formaldehyde per mole of dicyandiamide and the initial amount of phosphoric acid added is about 0.1 – 0.5 mole of phosphoric acid per mole of dicyandiamide, the amount of additional phosphoric acid is about 0.1 – 0.5 mole per mole of dicyandiamide.

* * * * *